US005325613A

United States Patent [19]

Sussmann

[11] Patent Number: 5,325,613

[45] Date of Patent: Jul. 5, 1994

[54] SHOE WITH A CENTRAL CLOSURE

[75] Inventor: Reinhold Sussmann, Scheinfeld, Fed. Rep. of Germany

[73] Assignee: Tretorn AB, Helsingborg, Sweden

[21] Appl. No.: 10,385

[22] Filed: Jan. 28, 1993

[30] Foreign Application Priority Data

Jan. 28, 1992 [DE] Fed. Rep. of Germany ... 9200982[U]

[51] Int. Cl.[5] ..... A43B 11/00

[52] U.S. Cl. ..... 36/50.1; 36/50.5; 24/712.2; 24/712.3

[58] Field of Search ..... 36/50.1, 50.5, 117; 24/68 SK, 69 SK, 71 SK, 712.2, 712.3, 713.5; 242/100.1

[56] References Cited

U.S. PATENT DOCUMENTS

| | | | |
|---|---|---|---|
| 3,193,950 | 7/1965 | Liou | 36/50.1 |
| 3,738,027 | 6/1973 | Schoch | 36/50.1 |
| 3,808,644 | 5/1974 | Schoch | 36/50.1 |
| 3,834,048 | 9/1974 | Maurer | 36/50.1 |
| 4,245,408 | 1/1981 | Larsen et al. | 36/50.1 |
| 4,433,456 | 2/1984 | Baggio | 36/50.5 |
| 4,870,723 | 10/1989 | Pozzobon et al. | 36/50.5 |
| 5,181,331 | 1/1993 | Berger | 36/50.1 |

FOREIGN PATENT DOCUMENTS 88252 1/1937 Switzerland .

*Primary Examiner*—Paul T. Sewell
*Assistant Examiner*—Marie Denise Patterson

[57] ABSTRACT

A shoe with a central closure (1) is provided with two tensioning devices (10, 11) which can be activated both simultaneously and independently of each other in order to close different areas of the shoe with the central closure (1). This makes it possible to tension one area of the shoe (2) or subsequently tension it further if the other area of the shoe (2) is already exposed to the necessary closing tension.

27 Claims, 5 Drawing Sheets

SHOE WITH A CENTRAL CLOSURE

BACKGROUND OF THE INVENTION

The invention concerns a shoe with a central closure, particularly a sport, recreation or rehabilitation shoe, with a central closure to which one or more rope-like tension elements are coupled and can, depending on the manner of activation, be shortened or elongated, whereby the tension element(s) can either extend, via deviation elements provided either on the shaft of the shoe or possibly also on an instep cover, back to the central closure and/or one tension element or both tension elements, particularly their ends, can be attached on the shaft or on the instep cover.

Such a shoe is disclosed in commonly owned, copending U.S. patent application Ser. No. 07/715,464, now U.S. Pat. No. 5,177,882, and which is a continuation-in-part of U.S. Pat. No. 5,117,567, and is known from corresponding German Utility Model Application 9016325. This shoe has established itself very well as a sports and recreation shoe having a low top upper and a single, revolving tension element. The noted application also describes an example in which one single central closure is used for two tension elements; but does not describe the full details of the central closure device itself.

However, such central closures, which use a rotary tensioning device to wind and unwind a rope-like tension element, have been known for sports shoes of the type used for skiing. An example of such a rotary tensioning device can be found in U.S. Pat. No. 5,042,177. A manually releasable ratchet mechanism is used to secure the tension element in the position to which it has been tightened. This central closure includes a single rope pulley to which a tension element is attached and a ring of ratchet teeth that are engaged by a spring biased detent prong to fix and release the rope pulley.

If a central closure of the noted types are used in a shoe having a high top upper, such as is common on basketball shoes, the problem occurs that different closure paths can exist in the area of the instep or the front of the foot than in the high top portion covering the ankle area or other regions of the shoe; this depends upon the foot or leg structure of the wearer and also upon the socks and/or other possible leg coverings which can possibly even extend into the throat of the shoe. In addition to this, the high top portion must, usually, be opened further than the portion of the shoe in the area of the instep or the front of the foot to ensure a comfortable entry and exit.

SUMMARY OF THE INVENTION

In view of the foregoing, the present invention has the objective of developing a central closure of the initially mentioned kind, in such a way that a perfect closure of the upper portions of the shoe over the instep as well as in the other areas of the upper, such as the high top portion of a high top shoe upper is made possible, even with differences in the lengths of the closure paths of the tension elements.

This objective is attained by providing the central closure with two tension elements that can be adjusted independently of each other. More specifically, coupling elements are provided by means of which one or both of the tension elements can be selectively activated in the closing direction, and that further clamping and/or detention elements are provided by means of which the adjusted position of the two tension devices can be secured or separated independently of each other, or are able to overcome the clamping effect.

By utilizing two tension devices in the central closure, which can be activated simultaneously as well as independently of each other, as well as providing the ability of simultaneous opening or release of the tension devices, it is possible to obtain individualized adjustment and thus an optimization of the effect of the central shoe closure. The central closure can be arranged at different locations of a shoe, even on a half shoe, with equal or approximately equal success, and is, thus, not limited to use on shoes of a high top construction; although, the invention is particularly advantageous for this purpose.

These and other objects features and advantages of the present invention will become apparent from the following detailed description when viewed in conjunction with the accompanying drawings which show, for purposes of illustration only, a single embodiment of the present invention.

DETAILED DESCRIPTION OF THE PREFERRED EMBODIMENT

Figures 1, 2:
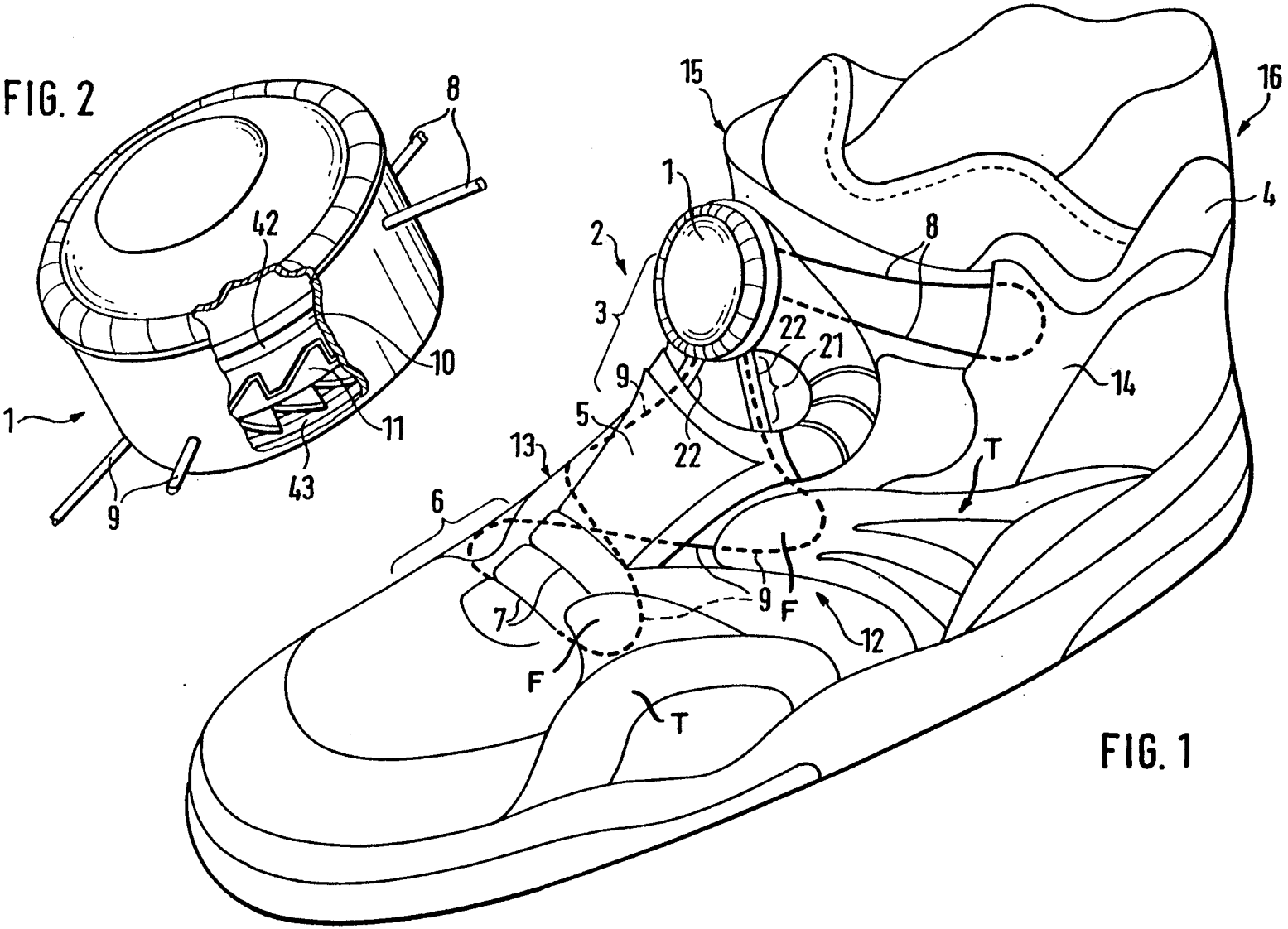
FIG. 1 is a perspective representation of a shoe with a high top upper that extends above the ankle.
FIG. 2 is a partially broken-away perspective view of a central closure for the shoe illustrated in FIG. 1, that is constructed according to the invention.

In FIG. 1, a central closure 1 is shown arranged in the joint area 3 of a shoe 2, particularly a sport, recreation or rehabilitation shoe. The illustrated shoe is a high top shoe as is, for example, used for basketball, indoor handball, baseball and other sports. The upper can also be constructed higher than illustrated in the drawings, so as to extend well above the ankle of the wearer.

An instep cover or shield 5 that, preferably, is formed of a hard flexible material originates below the central closure 1 and can extend up to the area 6 of the base joints of the toes, i.e., ball of the foot. It is possible to construct the instep cover 5 to be somewhat softer in the area 6 by using a softer material and/or providing transverse grooves 7 in order to allow an elastic bending in the area 6.

Two tension elements 8 and 9 are coupled to the central closure 1 and can, according to the invention, be activated in the closing (tightening) and opening (loosening) directions, both separately and simultaneously. Two tensioning devices 10, 11 are provided in the central closure 1, as can be seen in FIG. 2. The tensioning devices 10, 11 shown in the drawings are constructed as rope pulleys and can be activated independently of each other. One tension element (8 or 9) is rigidly connected with each rope pulley (10 or 11). The upper rope pulley 10 is connected with the tension element 9 that extends downward and forward into the frontal area of the foot, above the instep, and is connected to the lateral portions 12, 13 of the upper by guide elements. This tensioning element 10 makes it possible to close or contract the shoe 2 above the instep.

The other tension element 8 is attached to the rope pulley 11 that is arranged coaxially below the rope pulley 10, whereby the tension element 8 extends towards the rear in the ankle joint area 3, or above it towards the closing portions 14, 15 of the high top 16. This means that the high top 16 can be closed in the area of the ankle and above it.

Figure 3:
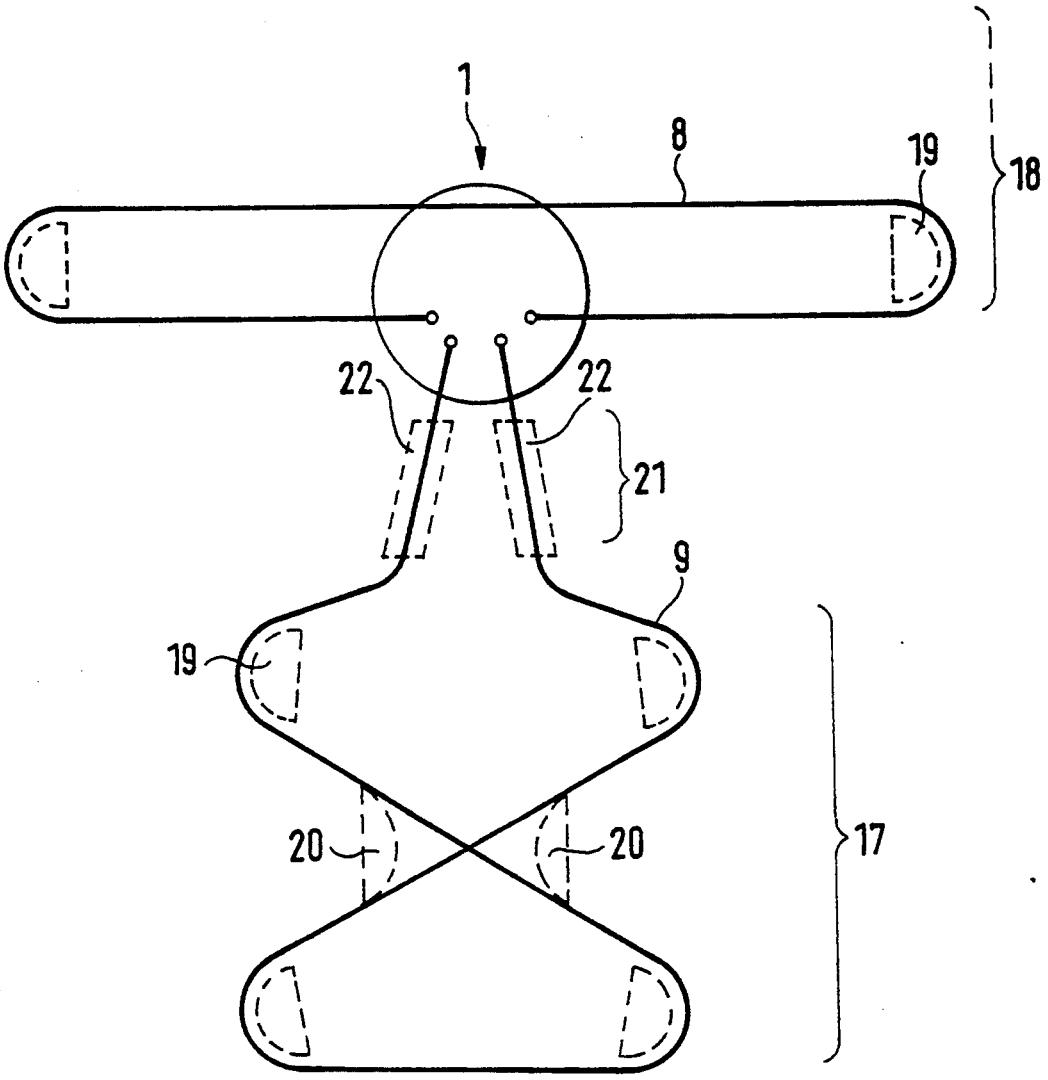
FIG. 3 is a diagrammatic sketch of the path of the tension elements in a shoe according to FIG. 1.

FIG. 3 schematically illustrates the previously mentioned closure areas. The closing or opening in the instep area 17 is executed by the tension element 9, and in the high top portion 16 in the ankle area 18 by the tension element 8. Suitable guide elements 19 are provided on the shoe upper, as is indicated in broken lines in FIG. 3 for change the path of the tension elements 8, 9 and which are drawn together by the tension elements to close the throat area of the upper.

In the arrangement shown, the tension element 9 crosses over itself once above the instep, for example, within guide grooves or the like provided on the instep cover. However, it is also possible to obtain a closure of the tension element 9 that is crossover-free by providing suitably opposed guide elements 20 (which are also indicated by broken lines in FIG. 3) on the instep cover 5.

Both the guide elements 19 and the optional guide elements 20 can be arcuate members constructed as shown for the guide elements of the initially mentioned U.S. Patent Application and the indicated parent thereof. Furthermore, the guide elements could be connected to a common closure flap or strip or otherwise mounted as described in those applications. For these reasons those applications are hereby incorporated by reference. However, as illustrated in FIG. 1, each guide element is fastened to the underside of a respective flap F which is part of or connected to a respective tensioning strap T that overlies or is secured on the lateral portions 12, 13 of the upper. In this regard, for example, the forward tensioning strap T of the illustrated shoe can be an arcuate band of leather sewn directly onto the upper and to which a separate closure flap is secured, while the rearward tension strap T can be a plastic part that extends over the material of the upper from anchoring points by the sole, the guide element being secured directly to a flap F that is formed by the free end of the tensioning strip itself. In either case, the guide element 9 might also be secured directly to the upper as well.

In order to prevent a contraction of the frontal portion of the shoe and the high top portion 16 in the joint area 3, and thus not limit its moveability, the sections 21 of the tension elements 9 extend in guides 22 that are arranged within this area. These guides are constructed so that they are very hard, if not impossible, to contract or constrict. These guides 22 are indicated by broken lines in FIG. 3 and constructed as relatively rigid tubes as shown in FIG. 1. The guides 22 can, for example, consist of a wire that is coiled into a tube as it is, for example, customary with Bowden cables. However, it is also possible to use suitable metal or plastic tubes or similar devices that can be integrated or attached to the instep cover 5 or another part of the shoe.

In order to obtain a shoe with elements that only slightly protrude over its surface, the central closure is advantageously constructed using flat disks as the tensioning devices. Examples of a central closure and tensioning devices are illustrated in detail in FIGS. 4 to 13, and described more fully in the following.

Figure 4:
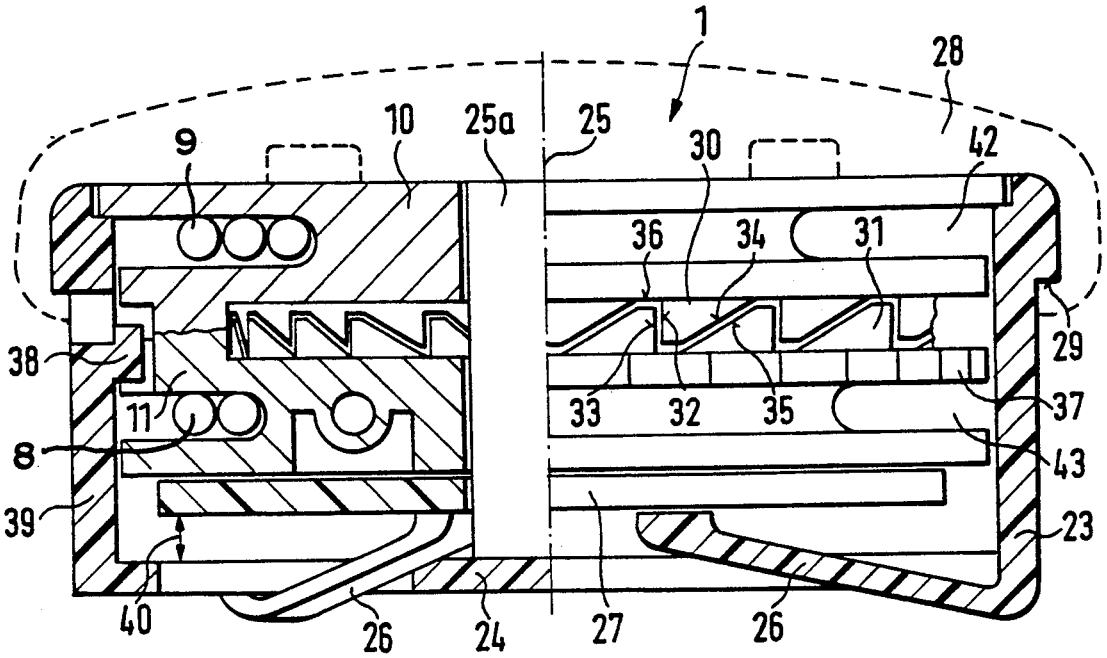
FIG. 4 is a cross-sectional side view of the central closure of FIG. 2 along the line 4—4 in FIG. 7.
Figure 5:
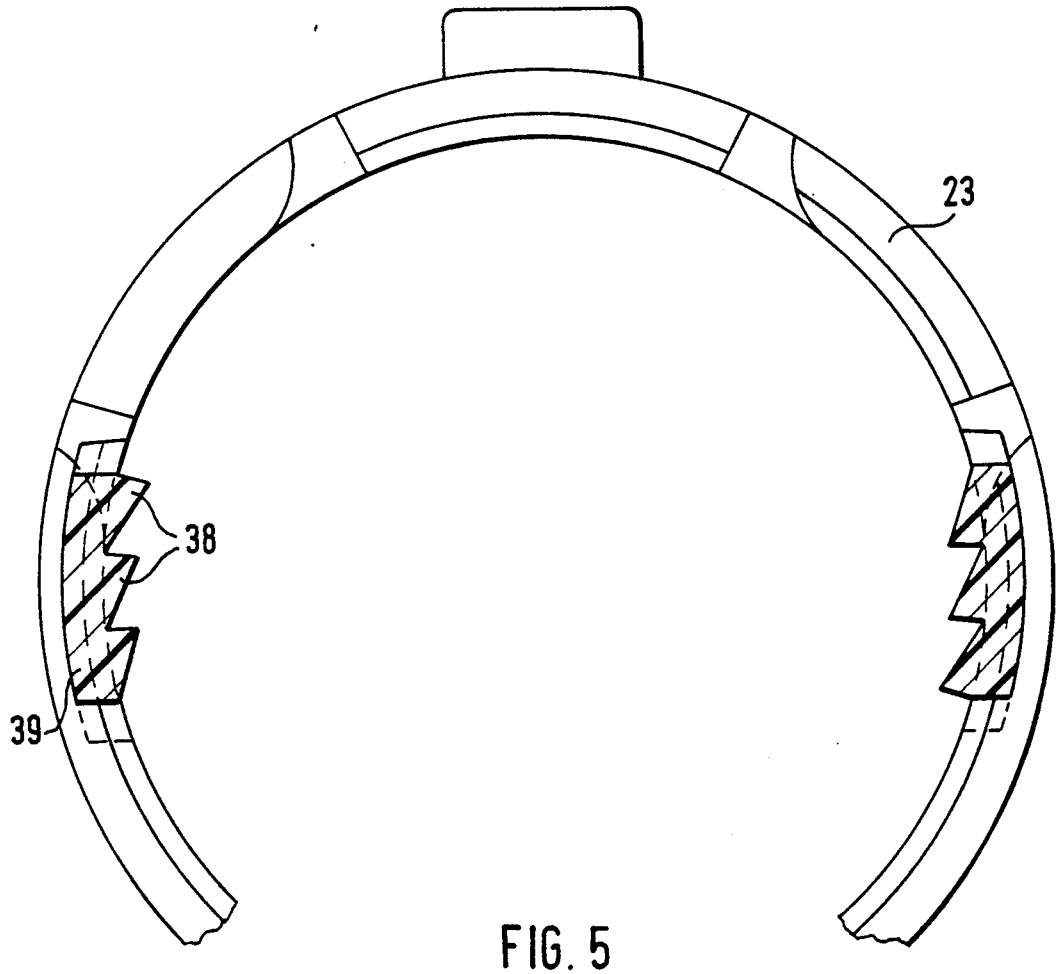
FIG. 5 is a partially cross-sectional top view of the perimetric wall of the housing part of the central closure.
Figure 7:
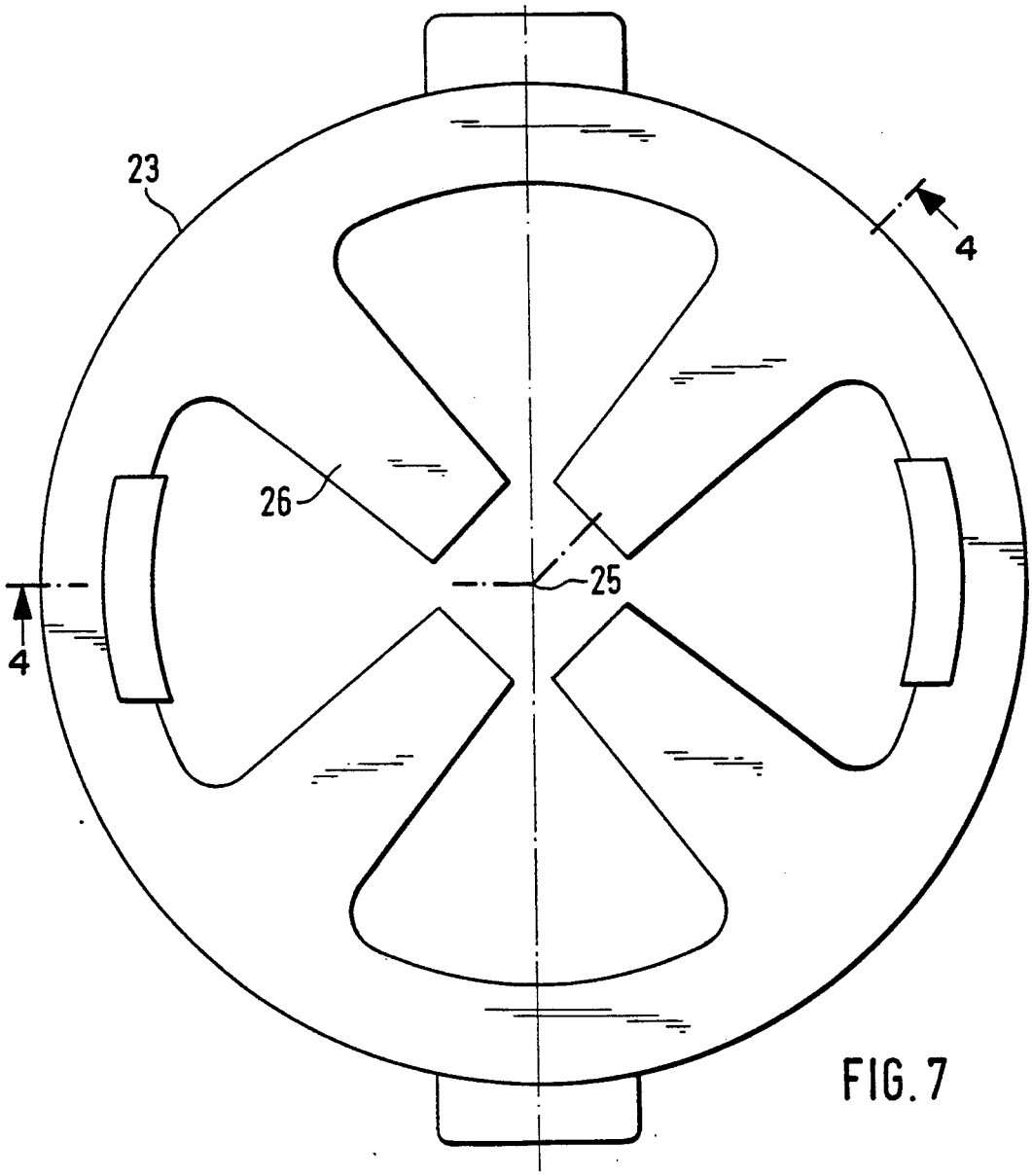
FIG. 7 is a bottom view of the housing part of the central closure.
Figure 8:
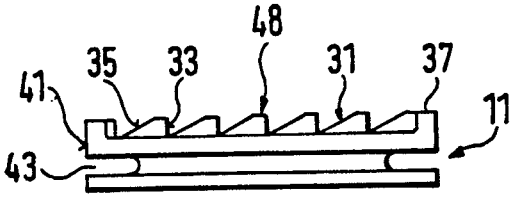
FIG. 8 is a side view of the lower tensioning device that is constructed as a rope pulley.

FIG. 4 shows a partial side cross-sectional view of the central closure 1 taken along the line 4—4 in FIG. 7, wherein the rope pulleys are illustrated in sectional representation in the left half of the drawing, and only the housing wall 23 of the central closure 1 is illustrated in sectional representation in the right half of the drawing.

The central closure 1 has a generally can-shaped housing with a circumferential wall 23 and a base portion 24. Elastic latches 26 are arranged on the housing wall 23, and extend radially inward relative to a central or rotation axis 25 while sloping upwardly the top of the central closure. An axially displaceable pressure disk 27, an axially displaceable, rotatable rope pulley 11 and a second rotatable rope pulley 10, which may also be axially displaceable, are arranged within the housing one on top of the other in the noted order, as shown in FIG. 4. The pressure disk 27 can possibly be omitted for space reasons.

A disk- or dome-shaped turning handle 28 (indicated in broken lines in FIG. 4) is provided on the rope pulley 10 and is coupled with it in a rigid manner which will enable rotation of the handle 28 to turn the rope pulley 10. The turning handle 28 catches behind a circular retention edge 29 on wall 23, so as to retain the assembly, in the arrangement shown, against the spring force of the elastic latches 26.

The rope pulleys 10, 11 are coupled with each other by coupling elements that operate to permit relative rotation of the pulleys in one direction but oppose it in an opposite direction. Each of the coupling elements comprises a ring of gear teeth, 30 or 31, which are equal and opposed to each other. The coupling elements are constructed in such a way that the activation of the turning handle 28, and thus the rope pulley 10, in the closing direction (which is clockwise as seen from a top view in the illustrated example) causes the lower rope pulley 11 to also rotate. During this process, the steep tooth profiles 32 or 33 engage with each other. On the other hand, the opposite tooth profiles 34, 35 have a relatively flat slope towards the base of the teeth 36, which allows the pulley 10 to be rotated relative to the pulley 11 with the tooth profiles 34, 35 passing over each other, the pulley 11 being able to shift axially against the force of elastic latches 26 for that purpose.

Figure 6:
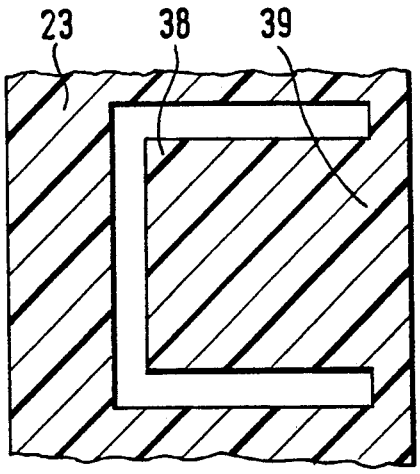
FIG. 6 is a cross-sectional side view of a detail of the wall of the housing part with a visible detention device.

The lower rope pulley 11 is also provided with a second ring of gear teeth 37 which, preferably, protrude radially. The teeth 37 of the rope pulley 11 are constructed in the same manner as in the teeth 31 and can engage detent prongs 38, which are provided on the housing wall 23 in a flexibly protruding manner. The housing wall 23, preferably, is formed of an elastic material, so that the detent prong spring 39 can also be formed from this material, particularly as part of the housing itself, as illustrated in FIG. 6. The gear teeth 37 and the detent prongs 38 are so wide and arranged towards each other in such a way that the axial lift 40 of the lower rope pulley 11 is dimensioned against the spring force of the latches 26 to such an extent that the gear teeth 37 are disengaged from the detent prongs 38 at a sufficient axial downward displacement of the rope pulley 11. This makes the disengagement of the rope pulley 11 possible.

Figure 9A:
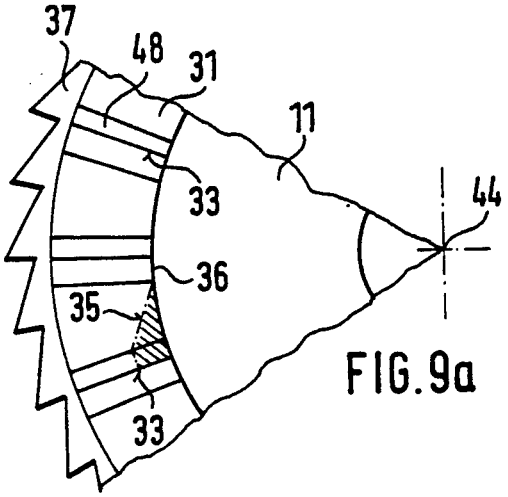
FIG. 9*a* is an enlarged detail of FIG. 9.
Figure 9:
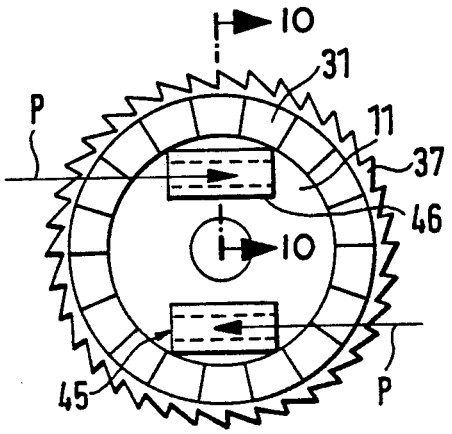
FIG. 9 is a top view of the rope pulley according to FIG. 8.
Figure 10:
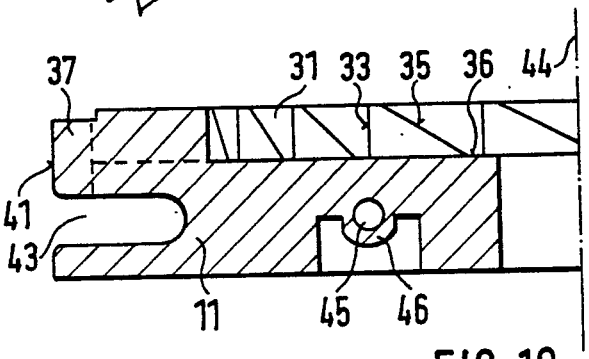
FIG. 10 is a sectional view taken along the line 10—10 in FIG. 9.
Figure 11:
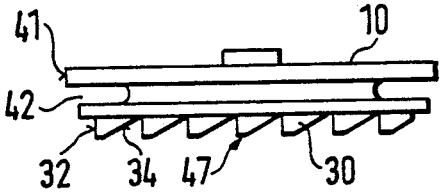
FIG. 11 is a side view of the upper tensioning device that is constructed as a rope pulley.
Figure 12:
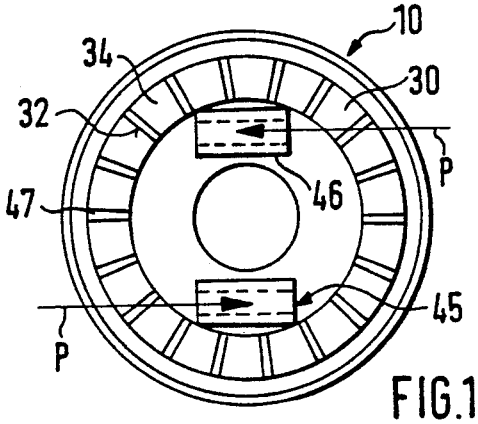
FIG. 12 is a bottom view of the rope pulley illustrated in FIG. 11.
Figure 13:
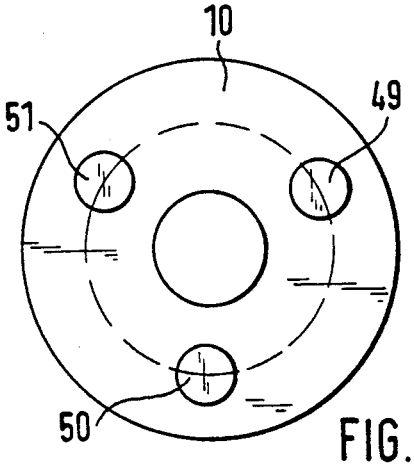
FIG. 13 is a top view of the rope pulley illustrated in FIG. 11.

The rope pulleys 10, 11 are provided with a corresponding rope-guidance groove 42, 43 around their periphery 41 for winding or unwinding the respective tension element 8 or 9. To securing the tension elements 8, 9 to the respective rope pulley 10, 11, each tension element is inserted, in the direction of the arrow P, into a bore 45 (FIGS. 9, 10) that is laterally offset from the center point 44 (FIG. 9*a*) or the central axis 25 (FIG. 4), and exits into the rope-guidance grooves 42 or 43. The tension element can be clamped within the bore 45 by deformation of the wall 46 containing the bore 45.

The effect of the central closure 1 during the closing of the shoe 2 from its opened condition is executed as follows:

The rope pulleys 10, 11 are in the position indicated in FIG. 4. If the upper rope pulley 10 is turned in the clockwise direction by rotation of the turning handle 28, the lower rope pulley 11 is positively and/or non-positively coupled with the upper pulley by the gear teeth 30, 31, and thus, also rotates. During this process, the detent prongs 38 jump over the teeth of the second ring of teeth 37 of the lower rope pulley 11 and then, retain the pulleys in their final rotational position against the force of the tension elements 8, 9. This means that both tension elements 8 and 9 are under tension. The shoe 2 is closed over the instep and the high top area of the upper is closed or brought into a partially closed position.

The high top portion 16 is usually not yet closed when the desired closing position is obtained in the frontal area of the foot, which means above the instep, since its closure path is considerably longer. In order to also obtain the desired closing effect in this area, the lower rope pulley must be rotated further in the closing direction to place the upper tension element 8 under greater tension without producing further rotation of the upper rope pulley 10 in the closing direction. This is obtained by a process of uncoupling and recoupling the two rope pulleys 10, 11. For this purpose, the upper rope pulley 10 is turned counterclockwise, which means in the opening direction, by the turning handle 28. The lower rope pulley 11 remains in its rotational position since it is remains retained by the detention prongs 38.

During this reverse rotation, the steep profiles 32, 33 of the gear teeth 30, 31 are disengaged, and the sloping tooth profiles 34, 35 slide on top of each other. This means that the lower rope pulley 11 is axially pressed downward against the force of the flexible latches 26 until the tips 47 of the teeth 30 jump over the tips 48 of the teeth 31 (FIGS. 8 and 11) and interlock in the corresponding following groove. However, this does not eliminate the retention effect between the detent prongs 38 and the gear teeth 37, but only reduces the penetration depth. Both rope pulleys 10, 11 are, then, moved, again, in the closing direction by rotation of the turning handle 28 in the closing direction once more. This means that the lower rope pulley 11 is turned further while the upper rope pulley 10 is brought into its previous closing position. A repeated back and forth rotation of the turning handle 28, thus, enables only the tension element 8 connected to the lower rope pulley 11 be further wound up, so that the closing effect on the high top area 16 is increased up to the desired closing position without bringing about a further tightening of the lateral areas 12, 13 of the upper by the tension element 9.

If this closing position should be maintained, the upper rope pulley 10 must maintain its rotation position after releasing the turning handle 28. In our example, this is executed by a sufficiently large frictional force that can be obtained between the turning handle 28 and the housing wall 23. However, it is also possible to interlock the upper rope pulley 10 in a similar manner as the lower rope pulley 11 and to make the disengagement possible by axial displacement, for example, by pressure applied onto the turning handle 28 or to an adjustment element provided in or below it. It is also possible to provide a suitable clamping device. One further variation consists of providing the lower rope pulley 11 with an equally effective clamping device instead of obtaining an interlocking effect by the second ring of gear teeth 37 and the detention prongs 38.

In order to bring both tensioning devices 10, 11 simultaneously into the opening position, an adjustment or disengagement element 25*a* can be provided, with which the detention and/or clamping effect of both tensioning devices 10, 11 is simultaneously eliminated. A preferred example is one where a single adjustment or disengagement element 25*a* is provided for both tensioning devices 10, 11.

Another variation consists of the fact that the upper rope pulley 10 is driven by a higher or lower ratio of transmission. This drive transmission could be provided instead of the turning handle 28, and would itself be provided with a turning handle. The drive in this particular instance can be obtained using a planetary gear with three planet pinions (49, 50, 51) (FIG. 13) that are offset to each other by 120° for example, by as is described in the Published European Application 0255869, FIG. 12, (and also in the noted in the above-mentioned U.S. Pat. No. 5,042,177) or as in other conventional central closures.

Once again, it is emphasized that the shoe provided with this innovative central closure does not necessarily have to have an ankle-high or higher top upper. It is also possible to provide half (low top) or similar shoes with the described central closure with double rope-like tension elements in order to ensure a better closing effect in different closure areas.

The utilization of two tensioning devices 10, 11 that can be adjusted simultaneously or independently from each other makes it possible to tighten a certain area of the shoe or subsequently tighten it, while the other area of the shoe already is exposed to the necessary closing tension.

I claim:

1. A sport, recreation or rehabilitation shoe, having an upper formed of an elastically flexible material at least at side parts thereof, two rope-type tension elements, guide elements on at least one of the upper and an instep cover, each of the rope-type tension elements being guided along a respective path by respective ones of said guide elements, and a central closure to which the two rope-like tension elements are coupled; wherein the central closure is provided with an operating member and two tensioning devices that are operatively connected to the operating member so as to be adjustable independently and jointly with respect to each other thereby, said central closure forming a means for selectively shortening and elongating the paths of the tension elements and thereby tightening respective portions of the upper, one tension element being coupled with each of the tensioning devices; wherein the tensioning devices are disengageably coupled to each other by coupling elements, said coupling elements being selectively disengageable as a means for enabling only one of the two tensioning devices to be activated in a closing direction by said operating member and being engageable as a means for enabling both of the tensioning devices to be simultaneously activated in the closing direction by the same operating member, depending on whether one or both of the tension elements is to be shortened to tighten the upper; and wherein detention means are provided for securing the two tensioning devices in a selected adjustment position independently of each other, such that the path of one of the tension elements can be shortened while enabling an attained position of adjustment of the other tension element to be maintained.

2. Shoe according to claim 1, wherein the two tensioning devices are arranged coaxially with respect to each other.

3. Shoe according to claim 2, wherein the two tensioning devices are arranged one above the other.

4. Shoe according to claim 3, wherein both tensioning devices are constructed as rope pulleys.

5. Shoe according to claim 4, wherein the coupling elements serve as a means for enabling the tensioning devices to be coupled with each other in a manner that is only effective in the closing direction.

6. Shoe according to claim 5, wherein the coupling elements are constructed as a ratchet-type coupling.

7. Shoe according to claim 6, wherein said coupling elements are constructed and arranged so as to positively couple a first one of the tensioning devices with a second of the tensioning devices during activation in the closing direction, whereby the second tensioning device can be moved in the closing direction with the first tensioning device; wherein said detention means is constructed and arranged so as to fix the second tensioning device in manner opposing movement in a direction opposite the closing direction; wherein the first tensioning device is movable in an opening direction by disengagement of the disengageable coupling elements as a means for enabling the first tensioning device to be reset and recoupled relative to the second tensioning device, so that both tensioning devices can be jointly moved in the closing direction and fixed in a new adjustment position.

8. Shoe according to claim 7, wherein the central closure is provided with a quick release mechanism so that at least the first tensioning device can be activated in the opening direction.

9. Shoe according to claim 1, wherein each of the tensioning devices is provided with a ring of gear teeth that has a steep tooth profile on one side and a flat tooth profile on an adjacent side; wherein at least one of the two tensioning devices is axially displaceable relative to the other tensioning device by at least one spring in a manner enabling the rings of gear teeth to disengage from each other, so that the two tensioning devices can be rigidly coupled with each other by the rings of gear teeth during movement of a first of the tensioning devices in the closing direction; and wherein a second of the tensioning devices remains fixed in its position during movement of the first tensioning device in an opening direction, whereby the flat tooth profiles slide on top of each other, separating the two tensioning devices to such an extent that tips of the teeth of one ring of gear teeth are able to jump over tips of the teeth of the other ring of gear teeth.

10. Shoe according to claim 1, wherein said central closure is of a substantially flat and compact design having a height which is less than its diameter.

11. Shoe according to claim 4, wherein a guidance groove for the rope-like tension element is provided on the peripheral surface of each of the tensioning devices.

12. Shoe according to claim 11, wherein the tensioning devices are constructed as disks and are provided with at least one bore that exits into the guidance groove; and wherein a portion of a respective one of the tensioning elements is fixed in the bore.

13. Shoe according to claim 9, wherein the tension device which is connected with the second tensioning device is mounted for closing a portion of the shoe above the instep; and wherein the tension element which is connected with the first tensioning element is mounted for closing a high top portion of the shoe that is at least as high as an ankle area.

14. Shoe according to claim 7, wherein the first tensioning device is coupled with a gear for being driven thereby.

15. Shoe according to claim 7, wherein a single disengagement element is provided as a means for simultaneously releasing the two tensioning devices.

16. Shoe according to claim 13, wherein the central closure is arranged on a part of the shoe that lies at a point that is beyond the instep in a direction from a toe area of the shoe.

17. Shoe according to claim 1, wherein both tensioning devices are constructed as rope pulleys.

18. Shoe according to claim 17, wherein the coupling elements serve as a means for enabling the tensioning devices to be coupled with each other in a manner that is only effective in the closing direction.

19. Shoe according to claim 18, wherein the tension elements are of different lengths and extend over different portions of the shoe.

20. Shoe according to claim 19, wherein said coupling elements are constructed and arranged so as to positively couple a first one of the tensioning devices with a second of the tensioning devices during activation in the closing direction, whereby the second tensioning device can be moved in the closing direction with the first tensioning device; wherein said detention means is constructed and arranged so as to fix the second tensioning device in manner opposing movement in a direction opposite the closing direction; wherein the first tensioning device is movable in an opening direction by disengagement of the disengageable coupling elements as a means for enabling the first tensioning device to be reset and recoupled relative to the second tensioning device, so that both tensioning devices can be jointly moved in the closing direction and fixed in a new adjustment position.

21. Shoe according to claim 20, wherein the tension element which is connected with the second tensioning device is mounted for closing a portion of the shoe above the instep; and wherein the tension element which is connected with the first tensioning device is mounted for closing a high top portion of the shoe that is at least as high as an ankle area.

22. A sport, recreation or rehabilitation shoe, having an upper formed of an elastically flexible material at least at side parts thereof, two rope-type tension elements, guide elements on at least one of the upper and an instep cover, each of the rope-type tension elements being guided along a respective path by respective ones of said guide elements, and a central closure to which the two rope-like tension elements are coupled; wherein the central closure is provided with an operating member and two tensioning devices that are adjustable independently and jointly with respect to each other and which form a means for selectively shortening and elongating the paths of the tension elements and thereby tightening respective portions of the upper, one tension element being coupled with each of the tensioning devices; wherein the tensioning devices are disengageably coupled to each other by coupling elements, said coupling elements being selectively disengageable as a means for enabling only one of the two tensioning devices to be activated in a closing direction by the operating member and being engageable as a means for enabling both of the tensioning devices to be activated in the closing direction by the same operating member, depending on whether one or both of the tension elements is to be shortened to tighten the upper; wherein detention means are provided for securing the two tensioning devices in a selected adjustment position independently of each other, such that the path of one of the tension elements can be shortened while enabling an attained position of adjustment of the other tension element to be maintained; wherein each of the tensioning devices is provided with a ring of gear teeth that has a steep tooth profile on one side and a flat tooth profile on an adjacent side; wherein at least one of the two tensioning devices is axially displaceable relative to the other tensioning device by at least one spring in a manner enabling the rings of gear teeth to disengage from each other, so that the two tensioning devices can be rigidly coupled with each other by the rings of gear teeth during movement of a first of the tensioning devices in the closing direction; wherein a second of the tensioning devices remains fixed in its position during movement of the first tensioning device in an opening direction, whereby the flat tooth profiles slide on top of each other, separating the two tensioning devices to such an extent that tips of the teeth of one ring of gear teeth are able to jump over tips of the teeth of the other ring of gear teeth; and wherein at least the second tensioning device is provided with a second ring of gear teeth which protrude in a radial manner and whose teeth releasably engage in elastically protruding detent prongs that are arranged in a peripheral wall of a housing of the central closure.

23. Shoe according to claim 22, wherein the second tensioning device is mounted in a manner enabling it to be axially displaceable out of engagement with the detent prongs.

24. Shoe according to claim 23, wherein the housing of the central closure is formed of an elastic material, and wherein the detent prongs are formed as cut-out portions of the housing wall of the central closure formed of elastic material.

25. A sport, recreation or rehabilitation shoe, having an upper formed of an elastically flexible material at least at side parts thereof, two rope-type tension elements, guide elements on at least one of the upper and an instep cover, each of the rope-type tension elements being guided along a respective path by respective ones of said guide elements, and a central closure to which the two rope-like tension elements are coupled; wherein the central closure is provided with an operating member and two tensioning devices that are adjustable independently and jointly with respect to each other and which form a means for selectively shortening and elongating the paths of the tension elements and thereby tightening respective portions of the upper, one tension element being coupled with each of the tensioning devices; wherein the tensioning devices are disengageably coupled to each other by coupling elements, said coupling elements being selectively disengageable as a means for enabling only one of the two tensioning devices to be activated in a closing direction by the operating member and being engageable as a means for enabling both of the tensioning devices to be activated in the closing direction by the same operating member, depending on whether one or both of the tension elements is to be shortened to tighten the upper; and wherein detention means are provided for securing the two tensioning devices in a selected adjustment position independently of each other, such that the path of one of the tension elements can be shortened while enabling an attained position of adjustment of the other tension element to be maintained; wherein the tension element which is connected with the second tensioning device is mounted for closing a portion of the shoe above the instep; and wherein the tension element which is connected with the first tensioning element is mounted for closing a high top portion of the shoe that is at least as high as an ankle area; wherein the central closure is arranged on a part of the shoe that lies at a point that is beyond the instep in a direction from a toe area of the shoe; and wherein the tension element for closing the portion of the shoe above the instep extends from the central closure within rigid guides that resist contraction under forces applied by the tension element guided thereby.

26. Shoe according to claim 25, wherein the rigid guides are arranged in the area of the foot joint.

27. Shoe according to claim 26, wherein the rigid guides are rigid tubes running from the central closure to an instep area.

* * * * *